US009359130B2

(12) United States Patent
Jean et al.

(10) Patent No.: US 9,359,130 B2
(45) Date of Patent: Jun. 7, 2016

(54) SEALED AND THERMALLY INSULATIVE TANK INTEGRATED INTO A SUPPORTING STRUCTURE

(75) Inventors: Pierre Jean, Dampierre en Yvelines (FR); Bruno Guelton, Ecoqueneauville (FR); Mickael Herry, Massy (FR); Matthieu Malochet, Paris (FR)

(73) Assignee: GAZTRANSPORT ET TECHNIGAZ (FR)

( * ) Notice: Subject to any disclaimer, the term of this patent is extended or adjusted under 35 U.S.C. 154(b) by 370 days.

(21) Appl. No.: 14/130,801

(22) PCT Filed: Jun. 26, 2012

(86) PCT No.: PCT/FR2012/051458

§ 371 (c)(1),
(2), (4) Date: Jan. 3, 2014

(87) PCT Pub. No.: WO2013/004943

PCT Pub. Date: Oct. 1, 2013

(65) Prior Publication Data

US 2014/0124086 A1 May 8, 2014

(30) Foreign Application Priority Data

Jul. 6, 2011 (FR) ..... 11 56092

(51) Int. Cl.
*B63B 25/16* (2006.01)
*B65D 88/12* (2006.01)
(Continued)

(52) U.S. Cl.
CPC ..... *B65D 88/128* (2013.01); *B63B 17/0027* (2013.01); *B65D 90/06* (2013.01);
(Continued)

(58) Field of Classification Search
CPC ..... B65D 88/128; B65D 90/06; B63B 25/16
USPC ..... 114/74 A
See application file for complete search history.

(56) References Cited

U.S. PATENT DOCUMENTS 3,339,782 A * 9/1967 Segura ..... F17C 13/082 114/74 A
3,339,783 A * 9/1967 Gorman ..... F17C 3/06 220/560.11

(Continued)

FOREIGN PATENT DOCUMENTS

DE 102006056821 6/2008
FR 1407871 8/1965

(Continued)

OTHER PUBLICATIONS

English translation of Office Action mailed Sep. 15, 2015 in corresponding Japanese Application No. 2014-517883, 3 pages.

*Primary Examiner* — Stephen Avila
(74) *Attorney, Agent, or Firm* — Berenato & White, LLC

(57) ABSTRACT

A sealed and thermally insulative tank includes thermal installation including a plurality of juxtaposed insulation blocks on the supporting structure and a seal including a plurality of sealing metal plates disposed on the insulation blocks and welded to each other. Mechanical coupling members extend through the thermal insulation at the level of the edges of the insulation blocks and hold the insulation blocks in bearing engagement on the supporting structure. The metal plates are disposed so that the edges of the metal plates are offset relative to the edges of the underlying insulation blocks. The metal plates are held in bearing engagement on the insulation blocks only by the coupling members. The mechanical coupling members are attached to the metal plates at the level of attachment points away from the edges of the metal plates.

19 Claims, 6 Drawing Sheets

(51) Int. Cl.

| | |
|---|---|
| ***F17C 3/02*** | (2006.01) |
| ***B63B 17/00*** | (2006.01) |
| ***B65D 90/06*** | (2006.01) |

(52) U.S. Cl.

CPC ..... *F17C 3/027* (2013.01); *F17C 2201/0157* (2013.01); *F17C 2201/052* (2013.01); *F17C 2203/0333* (2013.01); *F17C 2203/0354* (2013.01); *F17C 2203/0358* (2013.01); *F17C 2203/0631* (2013.01); *F17C 2205/0364* (2013.01); *F17C 2209/232* (2013.01); *F17C 2221/033* (2013.01); *F17C 2223/0161* (2013.01); *F17C 2223/033* (2013.01); *F17C 2260/011* (2013.01); *F17C 2260/013* (2013.01); *F17C 2270/0107* (2013.01); *F17C 2270/0113* (2013.01); *F17C 2270/0121* (2013.01); *F17C 2270/0123* (2013.01); *F17C 2270/0136* (2013.01)

(56) References Cited

U.S. PATENT DOCUMENTS 3,367,492 A * 2/1968 Pratt ..... F17C 13/001 114/74 A
4,116,150 A * 9/1978 McCown ..... B63B 25/16 114/74 A
4,127,079 A * 11/1978 Ito ..... B63B 25/12 114/74 A
4,128,069 A * 12/1978 Kotcharian ..... F17C 3/04 114/74 A
4,170,952 A * 10/1979 McCown ..... B63B 25/16 114/74 A
4,452,162 A * 6/1984 Harbaugh ..... B63B 25/16 114/74 A
6,145,690 A * 11/2000 Dhellemmes ..... B63B 25/16 220/4.12

FOREIGN PATENT DOCUMENTS

| | | | |
|---|---|---|---|
| FR | 1492959 | | 8/1967 |
| FR | 2413260 | A1 | 7/1979 |
| FR | 2798902 | | 3/2001 |
| FR | 2877637 | | 5/2006 |
| FR | 2877639 | | 5/2006 |
| FR | 2887010 | A1 | 12/2006 |
| JP | H09213230 | A | 8/1997 |
| JP | 2000079987 | A | 3/2000 |
| JP | 2006137421 | A | 6/2006 |
| JP | 2010528241 | A | 8/2010 |
| KR | 20090009284 | | 1/2009 |

* cited by examiner

SEALED AND THERMALLY INSULATIVE TANK INTEGRATED INTO A SUPPORTING STRUCTURE

CROSS-REFERENCE TO RELATED APPLICATIONS AND CLAIM TO PRIORITY

This application is a national stage application of International Application No. PCT/FR2012/051458 filed Jun. 26, 2012, which claims priority to French Patent Application No. 1156092 filed Jul. 6, 2011, of which the disclosures are incorporated herein by reference and to which priority is claimed.

The present invention concerns a sealed and thermally insulative tank integrated into a supporting structure, notably into the double hull of a ship for transporting liquefied natural gas.

Numerous embodiments of this type of tank have already been described in the prior art. The tank generally includes a primary barrier in contact with the liquid contained in the tank and a secondary barrier disposed between the primary barrier and the supporting structure constituted by the double hull of the ship; each of these barriers includes a thermally insulative layer covered with metal plates that provide the seal, the sealing plates covering the insulative layer on the side of the interior of the tank.

In one particular embodiment, the sealing barriers constituted by the aforementioned metal plates have corrugations in two orthogonal directions. This type of tank has already been described in French patent 1492959 which specifies that the corrugations of the primary sealing barrier preferably all project on the side of the interior of the tank. On the other hand, the corrugations of the secondary sealing barrier project toward the exterior of the tank and the secondary insulation barrier includes grooves for accommodating said corrugations therein. The fact of having projecting corrugations on the primary sealing barrier can have a number of drawbacks: firstly, the sheet metal constituting the primary sealing barrier may be deformed by the action of oscillations of the liquid transported by reason of the presence of the projecting corrugations; secondly, the projections cause difficulties with placement of the welding apparatus used to ensure the continuity of the seal.

Korean patent 10-2009-0009284 proposes to produce, for a tank of this type, a primary sealing barrier including re-entrant corrugations, i.e. corrugations facing toward the exterior of the tank; these corrugations are accommodated in grooves provided in the primary insulating barrier. The placement of the secondary sealing barrier imposes, by reason of the grooves being constituted by movement toward each other of two adjacent primary insulating blocks, the use of a secondary sealing barrier constituted by a "Triplex" composite film with the result that the secondary sealing barrier cannot benefit from the elasticity that makes it possible to have an array of corrugations.

Also known, for example from FR-A-2798902 or FR-A-2877639, are insulative and sealed tanks in which the two sealing barriers are produced with invar strakes with raised edges that are welded edge-to-edge on either side of parallel weld supports.

These weld supports are each accommodated in grooves of cover plates of parallelepiped-shape boxes forming the underlying insulative barrier in such a manner as to hold the sealed metal membrane onto these boxes.

It is desirable to offer as uniform as possible a supporting surface for the metal sealing membrane to avoid concentrations of stress in some areas of the sealing membrane.

One embodiment of the present invention therefore has for its first object a sealed and thermally insulative tank placed in a supporting structure, including:

secondary thermal insulation including a plurality of juxtaposed secondary insulation blocks on the supporting structure, a secondary seal including a plurality of sealed secondary metal plates disposed on the secondary insulation blocks and welded to each other, primary thermal insulation including a plurality of juxtaposed primary insulation blocks on the secondary seal, a primary seal including a plurality of sealed primary metal plates disposed on the primary insulation blocks and welded to each other, secondary mechanical coupling members extending through the secondary thermal insulation at the level of the edges of the secondary insulation blocks and holding the secondary insulation blocks in bearing engagement on the supporting structure, and primary mechanical coupling members extending through the primary thermal insulation at the level of the edges of the primary insulation blocks and holding the primary insulation blocks in bearing engagement on the secondary seal, characterized in that the primary metal plates, respectively the secondary metal plates, are disposed so that the edges of the metal plate are offset relative to the edges of the underlying primary insulation blocks, respectively secondary insulation blocks;

in that the primary metal plates, respectively the secondary metal plates, are held in bearing engagement on the primary insulation blocks, respectively the secondary insulation blocks, only by the primary mechanical coupling members, respectively the second mechanical coupling members, and in that the primary mechanical coupling members, respectively the secondary mechanical coupling members, are attached to the primary metal plates, respectively the secondary metal plates, at the level of attachment points away from the edges of the primary metal plates, respectively the secondary metal plates.

Particular embodiments of such a tank may have one or more of the following features.

In one embodiment, the primary metal plates, respectively the secondary metal plates, have a contour shape identical to the contour shape of the underlying primary insulation blocks, respectively secondary insulation blocks. For example, this contour shape may each time be rectangular, square, hexagonal or another shape enabling a mosaic type layout on the plane.

In one embodiment, the primary metal plates, respectively the secondary metal plates, are constituted of thin metal sheets conformed so as to have, in two orthogonal directions, corrugations projecting in the direction of the supporting structure, the primary insulation blocks, respectively the secondary insulation blocks, including grooves for accommodating said corrugations.

In one embodiment, the corrugations of a primary metal plate, respectively a secondary metal plate, are equidistant in each of their two directions.

In one embodiment, the distances between two successive corrugations of the two corrugation directions of a primary metal plate, respectively a secondary metal plate, are equal, so as to delimit on the two seals inter-corrugation areas of square shape when viewed perpendicularly to the supporting structure.

In one embodiment, a primary mechanical coupling member, respectively a secondary mechanical coupling member, bear on the primary seal, respectively the secondary seal, in a plane area situated between the orthogonal corrugations of said seal.

In one embodiment, the grooves that receive the corrugations of the primary sealing plates and secondary sealing plates have a U-shaped or V-shaped cross section, the opening of the groove being adapted to the shape of the cross section of the corrugations.

In one embodiment, the cross section of the grooves is a V, the branches of which form between them an angle greater than or equal to 90°.

In one embodiment, a groove of a primary insulation block, respectively a secondary insulation block, is each time delimited by shims introduced into a groove wider than the groove, the shims leaving passages in said groove between the primary insulation block, respectively the secondary insulation block, and the corrugation of a primary sealing plate, respectively a secondary sealing plate, accommodated in said groove to allow purging with a gas, for example nitrogen.

In one embodiment, a primary mechanical coupling member, respectively a secondary mechanical coupling member, include a plate distributing the forces on the primary sealing barrier, respectively the secondary sealing barrier, and primary force transmission means, respectively secondary force transition means, connected to said plate, the force transmission means of the secondary mechanical coupling member being connected to the supporting structure.

In one embodiment, the force transmission means of the primary mechanical coupling member are connected to a secondary mechanical coupling member coaxial with the primary mechanical coupling member.

In an alternative embodiment, the force transmission means of the primary mechanical coupling member are connected to a secondary insulation block at a distance from the edges of the secondary insulation block, the secondary mechanical coupling members associated with said secondary insulation block being offset relative to said primary mechanical coupling member.

In one embodiment, the primary insulation blocks, respectively the secondary insulation blocks, include notches on two opposite edges of said primary insulation blocks, respectively said secondary insulation blocks, the notches in two adjacent primary insulation blocks, respectively secondary insulation blocks, being each time aligned to define a housing adapted to allow a primary mechanical coupling member, respectively a secondary mechanical coupling member, to pass through it.

In one embodiment, the primary insulation blocks, respectively the secondary insulation blocks, are cut off at the corners of said primary insulation blocks, respectively said secondary insulation blocks, the cut-off corners of four adjacent primary insulation blocks, respectively secondary insulation blocks, each time defining a housing adapted to allow a primary mechanical coupling member, respectively a secondary mechanical coupling member, to pass through it.

In one embodiment, a primary insulation block, respectively a secondary insulation block, is constituted of a layer of insulative foam covered on its two larger faces by a plywood sheet.

Such a tank may form part of a terrestrial storage installation, for example for storing LNG, or be installed in a coastal or deep water floating structure, notably a methane tanker, a floating storage and regasification unit (FSRU), a floating production storage and offloading (FPSO) unit, etc.

In one embodiment, a ship for the transportation of a cold liquid product includes a double hull and a tank as described above disposed in the double hull.

One embodiment of the invention provides a method of loading or offloading such a ship wherein a cold liquid product is routed through insulated pipes from or to a floating or terrestrial storage installation to or from the tank of the ship.

One embodiment of the invention provides a transfer system for a cold liquid product, the system including a ship as described above, insulated pipes arranged to connect the tank installed in the hull of the ship to a floating or terrestrial storage installation and a pump for driving a flow of cold liquid product through the insulated pipes from or to the floating or terrestrial storage installation to or from the tank of the ship.

A second object of the present invention is a coupler for retaining, relative to a retaining structure, an element subjected to forces liable to lead to its separation from the structure, said element being delimited by two parallel rigid walls, the first wall being closer to the retaining structure and the second farther from it, characterized in that it includes:

- a first part that forms the base of the coupler and includes an external casing, said external casing being fixed to the structure, said casing enclosing a thermally insulative material plug and spring means that push said plug against the retaining structure via a nut;
- a second part that forms the head of the coupler and includes an external casing fastened to the element, said external casing enclosing a thermally insulative ring and a substantially cylindrical sleeve internally threaded at both its ends, the thread farther from the retaining structure receiving an end-piece equipped with a flange, which comes to bear on a plate carried by the second wall of the element, the casing being fastened to a peripheral plate placed in a tongue and groove manner between said plate and the second wall of the element; and
- finally, a first rod threaded at its two ends and screwed at one end into the sleeve of the head of the coupler and at the other end into the nut of the base of said coupler, the screwing of said rod assuring the retention of the element against the retaining structure.

The element retained relative to the retaining structure may be associated with a complementary element covered with a metal plate on the side opposite the retaining structure and the thread of the sleeve which is not occupied by the first rod may receive the threaded end of a second rod which provides the connection between the sleeve and a connector fastened to the complementary element, said connector including, in a complementary casing with the same structure as the head of the coupler, on the one hand, spring means disposed between an edge of the second rod and the complementary casing and, on the other hand, a threaded sleeve a flange of which, by being welded to the metal plate, enables the seal to be assured between the exterior space and the interior of the complementary element.

In a preferred embodiment, the nut of the coupler base has a square exterior shape the corners of which rub on the casing or on a part that is connected to it. The plates of the casings and/or the complementary casing of the coupler may have a rectangular shape. The second rod of the coupler advantageously has at least one portion of smaller section than the first rod.

In a preferred use of the coupler of the invention, the supporting structure is the double hull of a ship and the element subjected to separation forces is a sealed and thermally insulative barrier element of a tank integrated into the ship. The coupler may be associated with a complementary element constituting a primary barrier element, the element nearer the supporting structure constituting a secondary barrier element.

The threaded sleeve of the complementary casing advantageously receives, on the side farther from the supporting structure, the threaded end of means projecting relative to the metal plate, which means cover the complementary element. The first wall of the element associated with the coupler may bear against the supporting structure with smoothing shims disposed between them. The plate associated with that of the walls of the element and/or the complementary element that is farther from the retaining structure is a thin metal plate formed by welding identical sections; in a first variant, the plate sections are lap welded and include corrugations in two orthogonal directions. In another variant, the plate sections are welded with raised edges.

A third object of the present invention consists in apparatus for pressing two metal plates onto a plane support with a view to assuring the maintaining of their relative positions for an operation of lap welding of their free edges, characterized in that there is positioned in line with one of the plates a bearing member disposed at a certain distance from the edges to be welded and carrying a pivot point at a fixed distance above the plates to be welded, the pivot point of this bearing member being used as a pivot for a lever, one end of which is equipped with a pressure pad positioned in line with the edges to be welded, the lever being further subjected to the action of an actuator placed on one of the plates to be welded, the actuator being adapted to push the pad onto the edges to be welded to press the two plates one against the other in the vicinity of the weld site.

In a preferred embodiment, the actuator is an inflatable flexible tube which is disposed between the lever and an area of one of the plates to be welded which is away from the welding site; it is preferable for the pivot of the lever to be farther from the actuator than the pressure pad. In a particularly beneficial application, the plates to be welded are plates including rectilinear corrugations, notably parallel to the edges to be welded, each corrugation being positioned in a groove of the plane support; the grooves may have a V shape or a U shape in cross section and the branches of the V of a groove advantageously have an angular opening of approximately 90°. The bearing member may be disposed in the area between the pressure pad and the groove nearest said pad. In a preferred application, the plane support is a wall of a thermally insulative barrier element of a sealed and thermally insulative tank integrated into a supporting structure of the ship and the plates to be welded constitute, after welding, a sealing barrier of said tank, the bearing means associated with the lever being provided by a mechanical coupling member, which ensures cohesion of the thermally insulated barrier elements with the supporting structure of the tank; the bearing member associated with the lever consists of projecting means screwed into a threaded sleeve or end-piece fastened to a mechanical coupling member, said relief means being equipped with a peripheral flange that presses on the plates to be lap welded.

Some aspects of the invention consists in using as primary and secondary sealing barriers plates having an array of corrugations directed toward the exterior of the tank for both barriers. The advantage of such an arrangement is that both barriers can benefit from the elasticity that the arrays of corrugations enable and the drawbacks are eliminated that are caused by the presence on the primary sealing barrier of corrugations projecting toward the interior of the tank.

To explain the object of the invention more clearly, embodiments of the invention represented in the accompanying drawings will now be described by way of purely illustrative and nonlimiting example.

Figure 1:
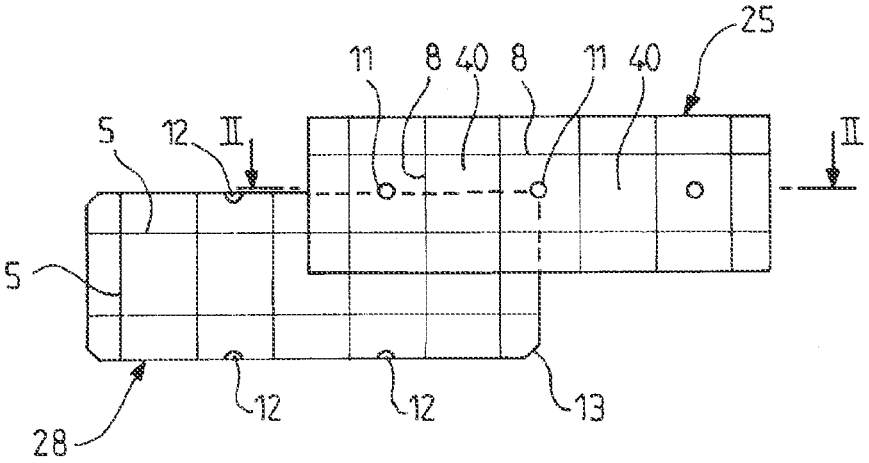
FIG. 1 represents in plan view the relative positioning of a sealed barrier unit and an insulative barrier unit for a first embodiment of the invention.
Figure 2:
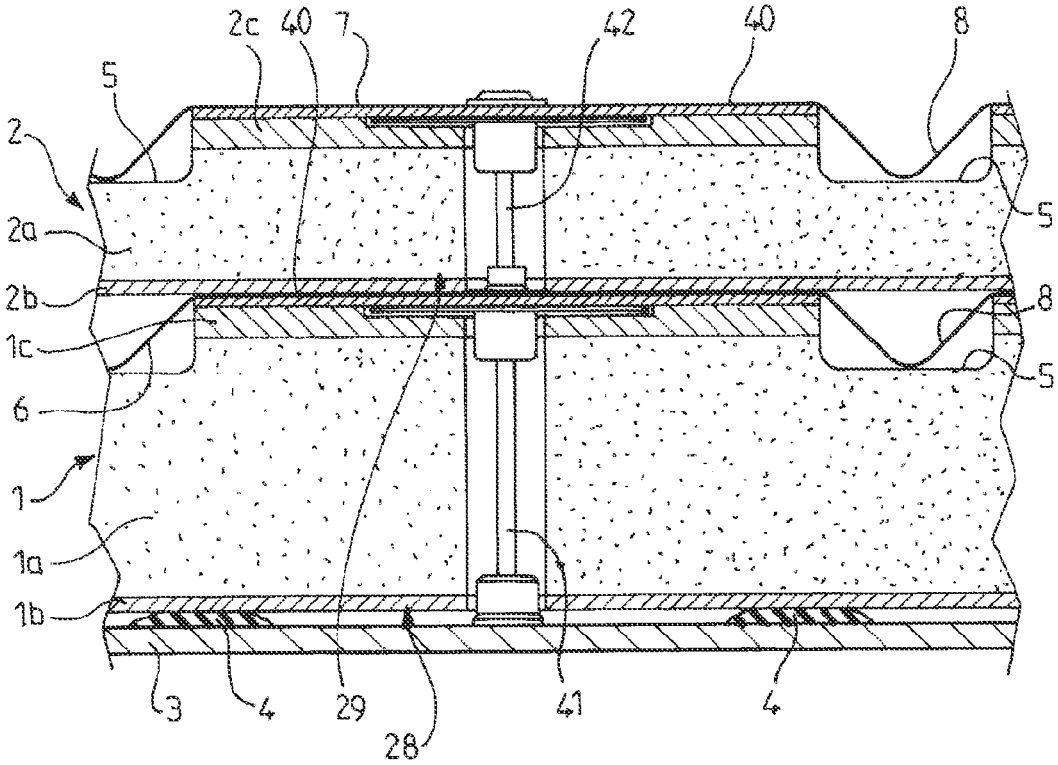
FIG. 2 represents a tank wall of a first embodiment seen in section taken along the line II-II in FIG. 1.
Figure 3:
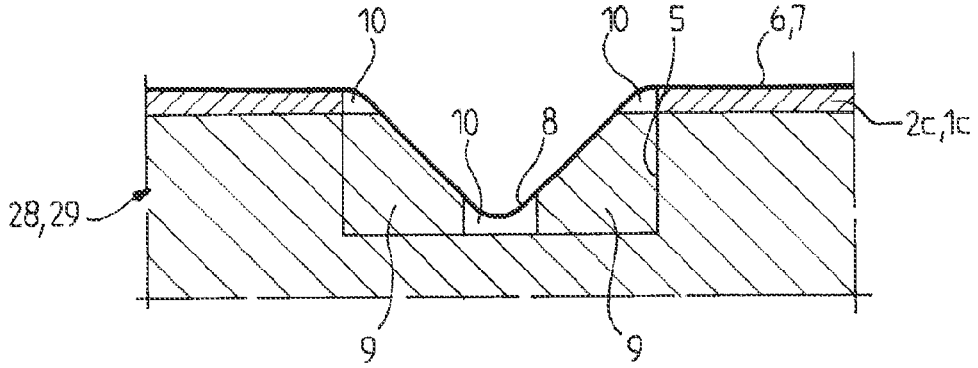
FIG. 3 represents one embodiment of the grooves in which the corrugations of the primary and secondary sealing barriers are placed.

Referring to FIGS. 1 to 3, a secondary insulation barrier 1 is formed of juxtaposed modular blocks and a primary insulation barrier 2 is formed of juxtaposed modular blocks. In the embodiment shown, these modular blocks are parallelepiped-shape slabs, namely secondary insulation slabs 28 and primary insulation slabs 29, but other geometries are also possible. Each of these secondary insulation slabs 28, respectively primary insulation slabs 29, is constituted of a thermally insulative foam panel 1*a*, respectively 2*a* of rectangular general shape; each panel 1*a*, respectively 2*a* is covered, on its larger faces, with a plywood backing sheet 1*b*, respectively 2*b*, and a plywood cover sheet 1*c*, respectively 2*c*. The backing sheet 1*b* of the secondary insulative slabs 28 is pressed against the supporting structure 3 of a ship by means of beads 4 of flexible mastic.

The cover plates 1*c* and 2*c* include grooves 5 having a rectangular cross section, said grooves extending as far as the foam layers 1*a* and 2*a*. Plane areas 46 are delimited between these grooves 5.

Each of the secondary insulation barriers 1, respectively primary insulation barriers 2, carries on its wall farther from the supporting structure 3 a sheet of metal, for example stainless steel, that constitutes a secondary sealing barrier 6, respectively a primary sealing barrier 7. Each of these secondary sealing barriers 6, respectively primary sealing barriers 7, is produced in the form of an assembly of rectangular metal plates, comprising secondary plates 25, respectively primary plates 25*a*, each of which includes corrugations 8 having a V-shaped profile, the two branches of the V having an angular opening of approximately 90°. An opening of more than 90° may also be produced, a smaller opening not being recommended because of the resulting welding difficulties. The corrugations 8 of each secondary metal plate 25, respectively primary metal plate 25*a*, are equidistant and produced in two orthogonal directions so that the array of corrugations defines plane inter-corrugation areas 40 of square shape (when seen perpendicularly to the supporting structure 3), as clearly visible in FIGS. 1 and 1A in the case of the secondary barrier. The primary barrier may be produced in exactly the same way.

The secondary metal plates 25, respectively the primary metal plates 25*a*, are disposed on the secondary insulative slabs 28, respectively the primary insulative slabs 29, so that the corrugations 8 are accommodated each time in the grooves 5 of the underlying insulative slabs, while the plane areas 40 bear on the corresponding cover plate 1*c* or 2*c* in a plane area 46. FIG. 3 represents a preferred variant of the grooves 5 containing the corrugations 8 of the sealing barriers 6 or 7. In this variant, the branches of the V, which constitute the cross section of the corrugation 8, are supported by wedges 9 which, in their upper portion and at the bend of the V, leave free areas that constitute passages 10 in which nitrogen may be circulated between the secondary sealing barrier 6 or the primary sealing barrier 7 and the secondary insulation slabs 28 or the primary insulation slabs 29. These passages constitute a beneficial safety device in the event of leaks. Also, the fact of supporting the branches of the V of the corrugation 8 increases the mechanical strength of the corrugations. Relaxation slots may be provided below the grooves 5.

The secondary insulation slabs 28 and the primary insulation slabs 29 are retained on the supporting structure 3 constituted by the double hull of the ship in which the tank is installed by means of mechanical coupling members systematically positioned at the perimeter of the insulation slabs 28 and 29 to be retained.

Figure 1A:
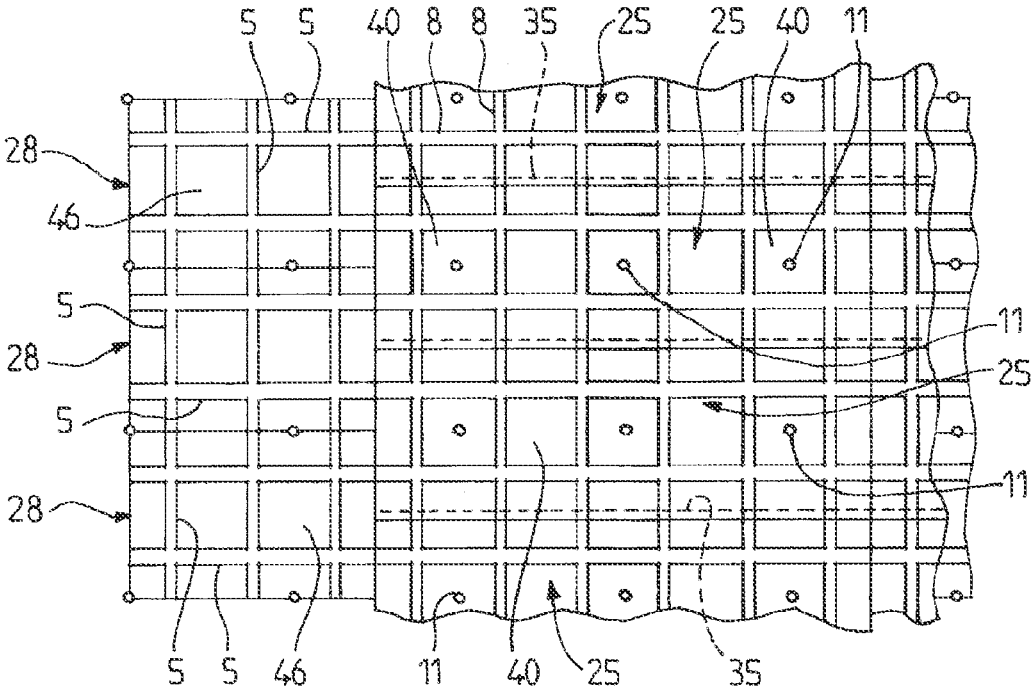
FIG. 1A represents partially in plan view a sealed and insulative tank wall including an assembly of sealed barrier units and underlying insulative barrier units, the insulative barrier being covered by the sealed barrier over only a portion of its surface.

FIGS. 1 and 1A represent the relative arrangement of the secondary insulation barrier 1 and the secondary sealing barrier 6 in one embodiment. The upper ends 11 of the secondary coupling members are seen in this plan view. A secondary metal plate 25 is the same size as a secondary insulation slab 28 and is disposed offset by one half-length and one half-width relative to the secondary insulation slabs that support it. Accordingly, the coupling members 11 situated on the edges of the secondary insulation slabs 28 are positioned at the centre of the square inter-corrugation areas 40 of the secondary metal plate 25. The lines 35 designate overlapping areas of the adjacent secondary metal plates 25. The relative arrangement of the primary insulation barrier 2 and the primary sealing barrier 7 may be exactly the same. The offset between the edges of the insulation slabs and the edges of the metal plates that they support has a number of advantages. On the one hand, the sealed welds between the edges of the adjacent metal plates are simpler if these edges are regular, which would not be the case if it were also necessary to provide points for attaching couplers at the level of the edges of the metal plates. On the other hand, the areas situated between adjacent insulation slabs, where the couplers are disposed, are liable to have slightly offset levels, because of the mounting clearance of each insulation slab. These areas are thus liable to offer a less uniform supporting surface for the metal sealing membrane than the centre areas of the insulation slabs, whence the possible concentration of stresses in these areas situated between the insulation slabs. In the proposed arrangement, the most fragile areas of the sealing membrane, namely the edges of the metal plates, are disposed over the areas where the supporting surface is most uniform, while the areas situated between the insulation slabs are covered by the central portion of the metal plates 25 or 25*a*, which is more resistant to stresses, notably because of the elasticity conferred by the corrugations 8.

Figure 4:
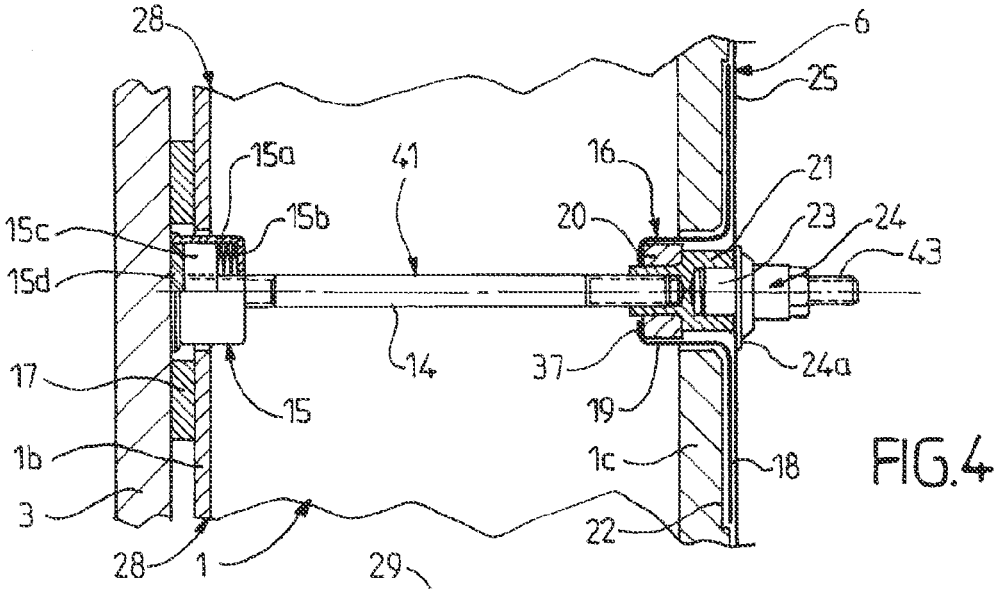
FIG. 4 represents, in section perpendicular to the supporting structure, the constitution of a secondary coupler retaining a sealed and insulative tank wall to assure its cohesion with the supporting structure, the tank wall in this figure being adapted to be equipped with only one thermal insulation barrier and only one sealing barrier.
Figure 5:
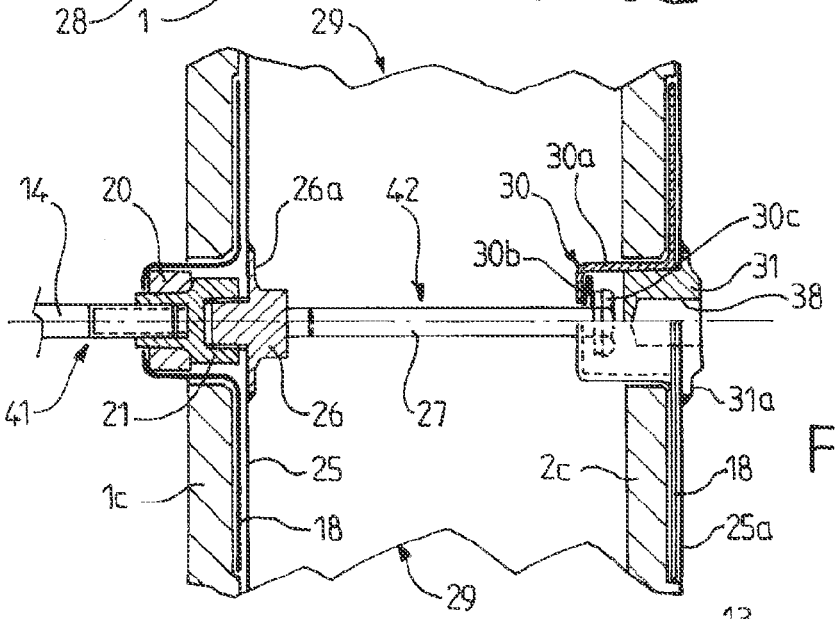
FIG. 5 represents in section perpendicular to the supporting structure a primary coupler intended to assure the cohesion between a primary barrier and an underlying secondary barrier itself retained on the supporting structure by a secondary coupler such as that represented in FIG. 4, the two couplers being coaxial.
Figure 6:
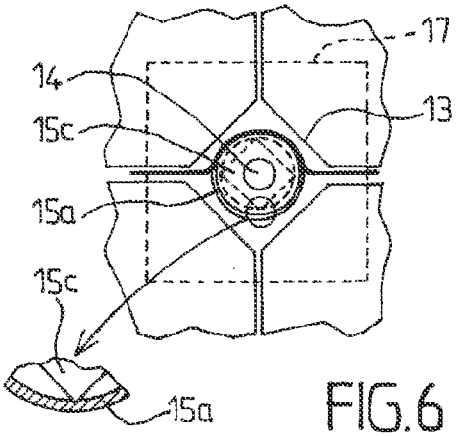
FIG. 6 represents in detail the base of the secondary coupler from FIG. 4 as seen along the axis of its rod and in section perpendicular to said axis at the level of the captive nut.
Figure 7:
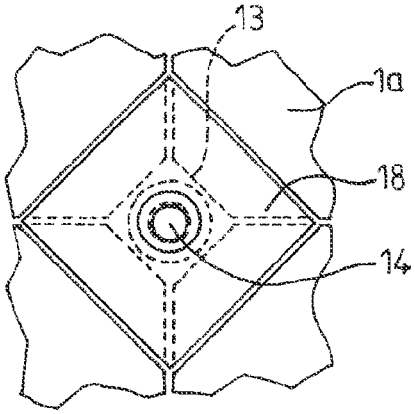
FIG. 7 represents, in plan view, a section of the head of a primary or secondary coupler according to FIGS. 4 and 5, at the level of the plate fitted below the primary or secondary sealing barrier.

A first embodiment of the tank wall will now be described. FIG. 2 provides an overall representation of this first embodiment, and FIGS. 4 and 5 give a detailed representation of the mechanical coupling members thereof.

As is clearly visible in FIG. 2, the coupling members here include secondary couplers 41 and primary couplers 42 that are coaxial: the primary coupler 42, which passes through the primary insulation barrier 2, is disposed on the same axis as the secondary coupler 41, which passes through the secondary insulation barrier 1. Each time, the passages for the secondary couplers 41, respectively the primary couplers 42, through the secondary insulation barrier 1, respectively the primary insulation barrier 2, are constituted by notches 12 in the edges of the secondary insulation slabs 28, respectively the primary insulation slabs 29, and by corner notches 13 produced at the corners of the secondary insulation slabs 28, respectively the primary insulation slabs 29. The complete housing of a secondary coupler 41, respectively a primary coupler 42, is constituted by two notches 12 produced in two adjacent insulation slabs or by the four notches 13 of four adjacent insulation slabs.

As indicated hereinabove, the coupling system of the primary insulation barriers 2 and the secondary insulation barriers 1 relative to the supporting structure 3 is constituted with two types of couplers 41 and 42. One embodiment of a secondary coupler 41 is represented in FIG. 4. This secondary coupler, which serves to hold the secondary insulation barrier 1 against the supporting structure 3, could be used for embodiments in which the tank is insulated by a single insulation barrier.

The coupler 41 is constituted of a rod 14 that connects a coupler base 15 welded to the supporting structure 3 and a coupler head 16 fastened to the cover sheet 1*c* of a secondary insulation slab 28. The coupler base 15 includes a casing 15*a* welded to the supporting structure 3. The casing 15*a* is substantially cylindrical and encloses a stack of Belleville washers 15*b* and a nut 15*c* screwed onto the rod 14. The nut 15*c* is square in shape and the corners of the nut rub on the casing 15*a* to prevent rotation of the nut 15*c*. The backing sheet 1*b* of the secondary insulation slab 28 bears on a smoothing shim 17. The smoothing shim 17 ensures the flatness of the bearing engagement and makes possible partial demounting of the insulation.

The cover sheet 1*c* of the secondary insulation slab 28 includes an opening for a cylindrical casing 19 that delimits the head 16 externally to pass through. This casing 19 is constituted by a stamped cylinder at the centre of a square fixing plate 18. The cylindrical casing 19 encloses a thermally insulative ring 20 sleeved around the end of a sleeve 21. The sleeve 21 includes a threaded bore at each of its two ends: in one of these bores is placed that of the threaded ends of the rod 14 that does not cooperate with the nut 15*c*. The plate 18 is positioned in a spot facing 22 of the cover plate 1*c* and is covered by the secondary sealing barrier 6. A folded edge 37 of the cylindrical casing 19 prevents any movement of the plate 18 and thus transmits any tear-off forces to which the secondary insulation slab 28 is subjected to the supporting structure 3 via the rod 14. The elastic play obtained thanks to the Belleville washers 15*b* compensates thermal contractions and any dynamic deformations of the hull. The fact of having provided a threaded bore at the end of the sleeve 21 opposite the rod 14 enables the threaded portion 23 of a male end-piece 24 including a flange 24*a* to be placed in this bore. The threaded portion 23 is engaged through a perforation of the secondary metal plate 25 and screwed into the sleeve 21. Thus the male end-piece 24 constitutes an attachment point that enables the secondary metal plate 25 to be held against the cover sheet 1*c*. The flange 24*a* enables the production of a sealed weld on the secondary metal plate 25 around said perforation to re-establish the seal at the level of this attachment point.

This male end-piece 24 may be used to place in the tank scaffolding or mounting tools or apparatus for pressing the plates constituting the sealing barriers when they are joined by a lap weld.

In FIG. 5 there is represented the use of the secondary coupler 41 that has just been described for fixing coaxially a primary coupler 42 such as that represented in FIG. 2. The left-hand part of FIG. 5 corresponds to the head 16 of the secondary coupler 41 represented in detail in FIG. 4, except that the male end-piece 24 has been replaced by a female end-piece 26 including a threaded bore at the end farther from the supporting structure 3. This end-piece 26 also includes a peripheral flange 26*a* adapted to be welded to the secondary metal plate 25 that constitutes the secondary sealing barrier 6. It receives in its threaded bore the threaded end of a rod 27 analogous to the rod 14. The threaded portion of the rod 27, which fits in the end-piece 26, has the same diameter as the rod 14, but the residual length of the rod 27 has a smaller diameter to enable fracture in the area of connection of the two diameters if the forces exerted on the coupling members are greater than a tolerable limit. The rod 27 passes through the primary insulation barrier 2 into a connector 30 that assures the connection between the rod 27 and the cover plates 2*c* of two or four primary insulation slabs 29. This connector 30 includes a casing 30*a* entirely analogous to the cylindrical casing 19 of the head of the secondary coupler 41 from FIG. 4. the casing 30 is a cylindrical stamping produced in the central area of a plate 18 identical to that from FIG. 4 and positioned in the same manner under the primary metal plate 25*a*. The plate 18 is rectangular. Inside this casing 30*a* are disposed Belleville washers 30*b* and a rim 30*c* on the rod 27 bearing on the Belleville washers 30*b*. In the casing 30*a* there is positioned a threaded sleeve 31 including, along its axis, an exterior thread screwed into the cylindrical casing 30*a* and a threaded hole 38 facing toward the interior of the tank, which enables the fixing of projecting means of the same type as the male end-piece 24 represented in FIG. 4, not represented here in FIG. 5. The threaded sleeve 31 includes a peripheral flange 31*a* that may be welded to a primary metal plate 25*a*. The coupling members that have just been described enable a small relative rotation of the various assembled elements.

The bearing of the flange 24*a*, respectively 31*a*, on the secondary metal plate 25, respectively the primary metal plate 25*a*, enables the secondary sealing barrier 1, respectively the primary sealing barrier 2, to be held in bearing engagement with the cover sheet 1*c*, respectively 2*c*, of the secondary insulation slabs 28, respectively the primary insulation slabs 29. Subject to a sufficient density of primary and secondary couplers, no other attachment is therefore necessary to retain the sealed membranes on the walls of the tank. The edges of the walls and the connections between the sealing barriers at the level of the corners between two walls of the tank may be produced by welding metal sealing plates to angle irons by the known technique.

Figure 8:
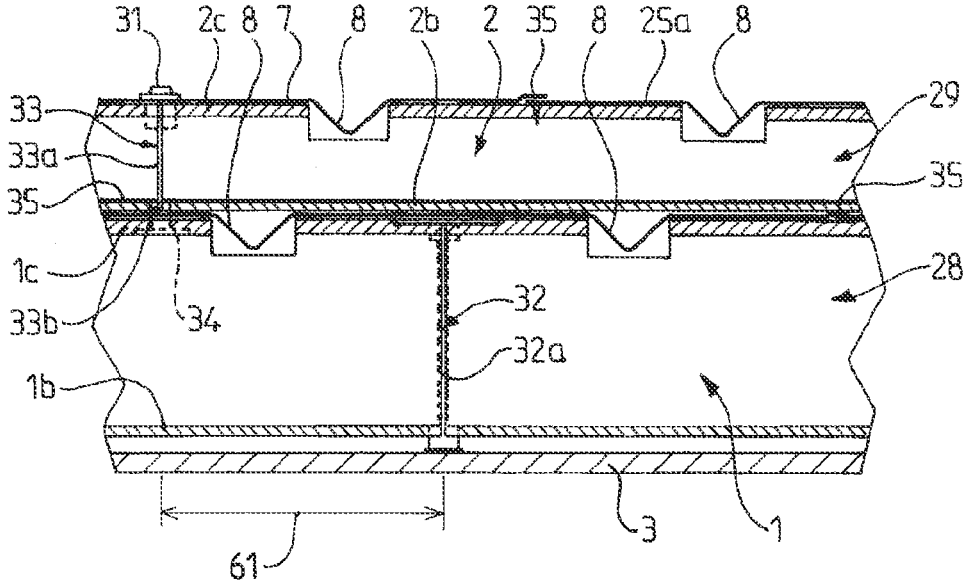
FIG. 8 is a view analogous to FIG. 2 representing a tank wall of a second embodiment, the secondary barrier being retained against the supporting structure by secondary couplers and the primary barrier being retained on the secondary barrier by primary couplers, the two types of coupler being offset in the two directions of the grooves produced in the primary and secondary insulation units.
Figure 9:
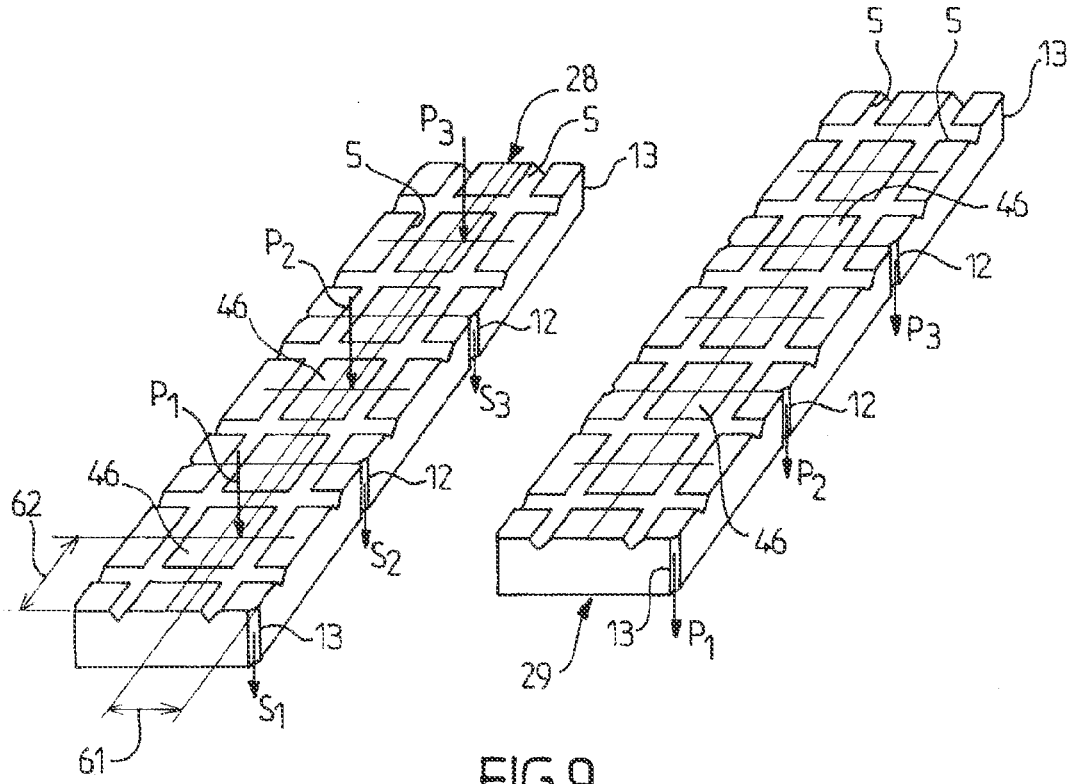
FIG. 9 represents, in perspective, a primary insulation barrier unit and a secondary insulation barrier unit of the wall from FIG. 8, the arrows showing the positioning of the primary and secondary couplers.
Figure 10:
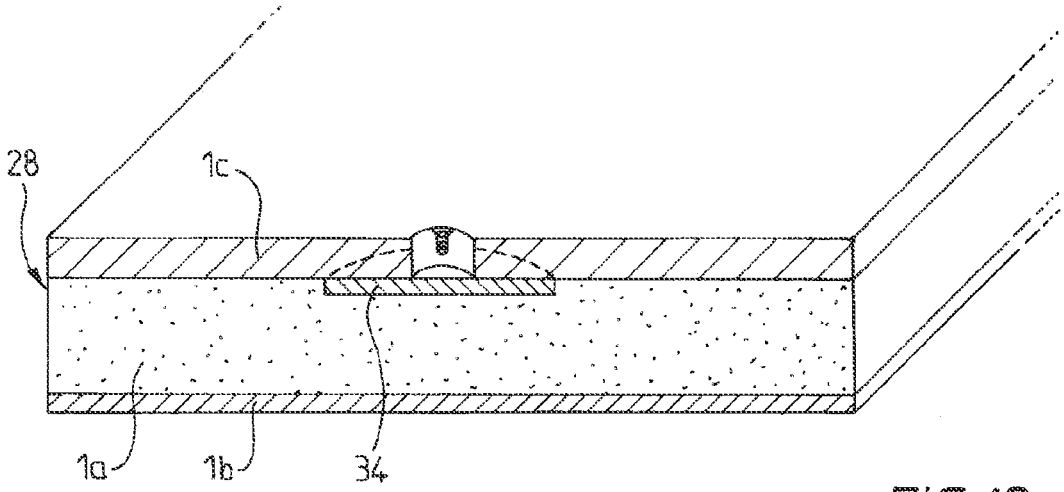
FIG. 10 represents in detail the socket that enables docking of the base of a primary coupler in the embodiment of FIGS. 8 and 9.

FIGS. 8 to 10 represent a second embodiment of a tank wall in which the coupling that retains the primary insulation barriers 2 and the secondary insulation barriers 1 against the supporting structure 3 is produced by primary couplers 33 and secondary couplers 32 which are not aligned in their portion where they pass through the primary insulation barrier 2 and the secondary insulation barrier 1. In this embodiment, the primary insulation slabs 29 and the secondary insulation slabs 28 are identical to the corresponding ones in FIGS. 1 and 1A, but are disposed differently. Instead of disposing a primary insulation slab 29 exactly in vertical alignment with a secondary insulation slab 28, here the primary insulation slabs 29 are offset relative to the secondary insulation slabs 29 by a certain distance in both directions of the plane of the tank wall. The lateral offset distance 61 is less than half the width of the slabs in the example represented in FIGS. 8 and 9. The longitudinal offset distance 62 is equal to the longitudinal distance between two corrugations 8 in the example represented in FIG. 9.

Under these conditions, the primary couplers 33 and the secondary couplers 32 are no longer in alignment with each other, as is clearly visible in FIG. 9, in which the positions of the primary couplers 33 are represented by the arrows P1, P2 and P3 and the positions of the secondary couplers 32 are represented by the arrows S1, S2 and S3. Not all the couplers have been represented in FIG. 9. Eight couplers may typically be used per insulation block, depending on the dimensions of the insulation blocks.

In this embodiment, the secondary coupler 32 is constituted of a rod 32*a* which is connected by one of its ends to the supporting structure 3 and by its other end to the cover wall 1*c* of the secondary insulation slabs 28. The connections mentioned above may be made in exactly the same way as in the first embodiment.

The primary coupler 33 includes a rod 33*a* which is connected by one of its ends to the cover sheet 2*c* of two or four primary insulation slabs 29 and by its other end to the cover sheet 1*c* of a secondary insulation slab 28 at a distance from the edges thereof. The connection of this rod 33*a* with the cover sheets 2*c* is effected with a device exactly corresponding to that shown in the right-hand part of FIG. 5 and described above. The connection of the rod 33*a* with the cover sheet 1*c* is effected by the cooperation of a thread on the rod 33*a* with a socket 34 represented in FIG. 10. At the level where it passes through the secondary sealing barrier 6, the rod 33*a* includes a flange 33*b* that is welded to the secondary metal plate 25 constituting the secondary sealing barrier.

In this embodiment, the offsetting of the primary couplers 33 and the secondary couplers 32 enables limitation of the thermal bridges between the interior of the tank and the supporting structure 3. Moreover, an offset is preserved each time between the secondary metal plates 25, respectively the primary metal plates 25*a*, and the secondary insulation slabs 28, respectively the primary insulation slabs 29, that support them, in the same manner as in the first embodiment. There is obtained in this way an arrangement of the tank wall in which the four successive layers forming the tank wall have a respective offset mosaic type arrangement. In other words, each of the following four elements is offset in position relative to the other three in the two directions of the plane: the secondary insulation slab 28, the secondary metal plate 25, the primary insulation slab 29 and the primary metal plate 25*a*.

Figure 11:
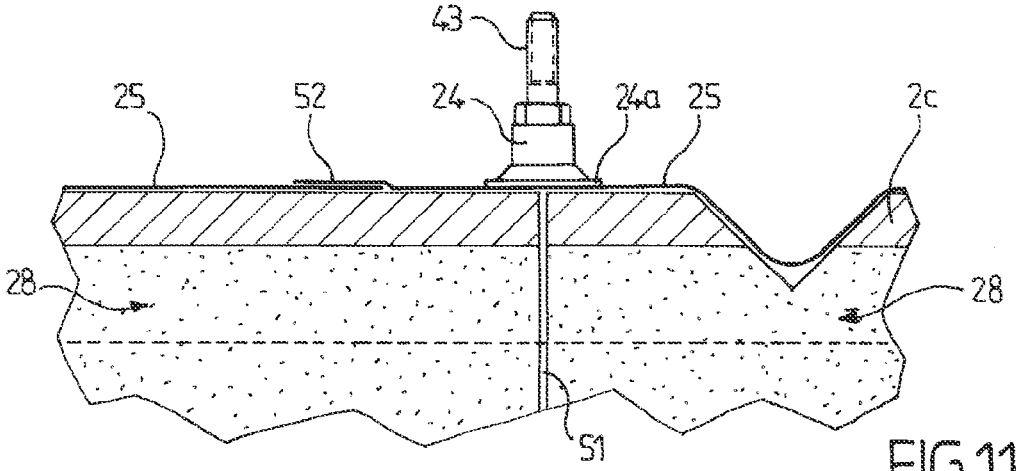
FIG. 11 represents the positioning of a projecting bearing member on the primary sealing barrier, in line with a coupling member of the primary barrier, at the junction of two adjacent elements of the primary insulation barrier, this view being a partial section perpendicular to the supporting structure and to the median line of a corrugation of the primary sealing barrier.

In FIG. 11 there has been represented in section a primary or secondary sealing barrier equipped with a male end-piece 24 such as that previously described and represented in FIG. 4. Elements already described that are encountered again in the embodiment of FIGS. 11 and 12 have been designated in those new figures by the same references as for FIGS. 1 to 10 and their description has not been repeated in detail. To facilitate the remainder of this description, it will be assumed that FIG. 11 represents a secondary barrier, but the situation would be exactly the same if it were a primary barrier. There are seen the adjacent areas of two secondary insulation slabs 28 with their plywood cover sheets 1*c*. As shown in FIGS. 1 and 1A, coupling members (not visible in FIG. 11) are disposed in the plane 51 situated between two adjacent secondary insulation slabs 28. The secondary sealing barrier 6 is constituted by the assembly of the sheet metal plates 25, this assembly being effected by a lap weld 52 of two adjacent sheet metal plates.

Figure 12:
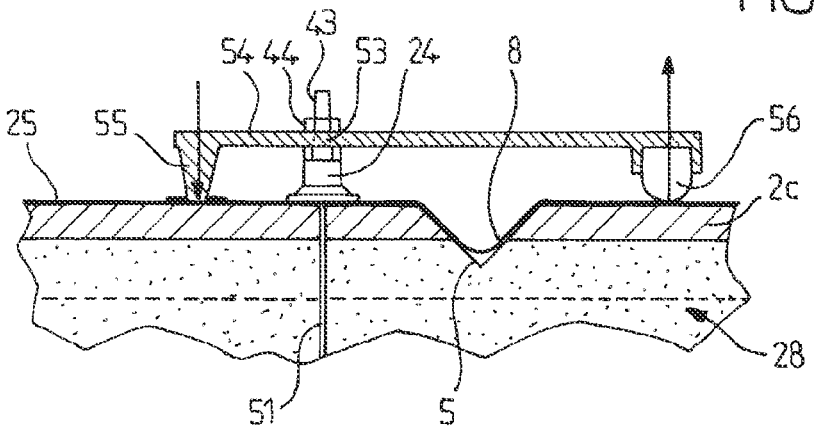
FIG. 12 represents, in a section analogous to that of FIG. 11, the use of a bearing member for apparatus intended to press one against the other the borders of two primary sealing barrier plates to be lap welded to provide the seal.

FIG. 12 represents apparatus placed in the wall area described above and represented in FIG. 11. Here the male end-piece 24 constitutes a pivot point 53 for a lever 54 that carries at one of its ends a pressure pad 55 and at its other end an actuator constituted by an inflatable flexible tube 56. The lever 54 includes a bore in which is engaged the threaded rod 43 of the male end-piece 24 with sufficient clearance to enable some angular relative movement of the lever 54. A nut 44 maintains this engagement. The pivot point 53 is nearer the pressure pad 55 than the inflatable tube 56 to multiply the force generated by the tube 56 and to make a high pressure available at the level of the pad 55. The dimensions of the lever are such that the distance 53-55 measured parallel through the metal plates 25 is equal to the distance between the plane 51 and the axis along which the lap weld 52 must be made. It is seen that, as a result, the pressure pad 55 is pressed onto the site of the lap weld 52, which enables the two plates 25 to be welded to be pressed together at the level of the weld site without it having been necessary to carry out any tack welding beforehand.

The techniques described above for producing a tank wall may be used in different types of storage tanks, an LNG storage tank in a terrestrial installation or in a floating structure such as a methane tank ship etc.

Figure 13:
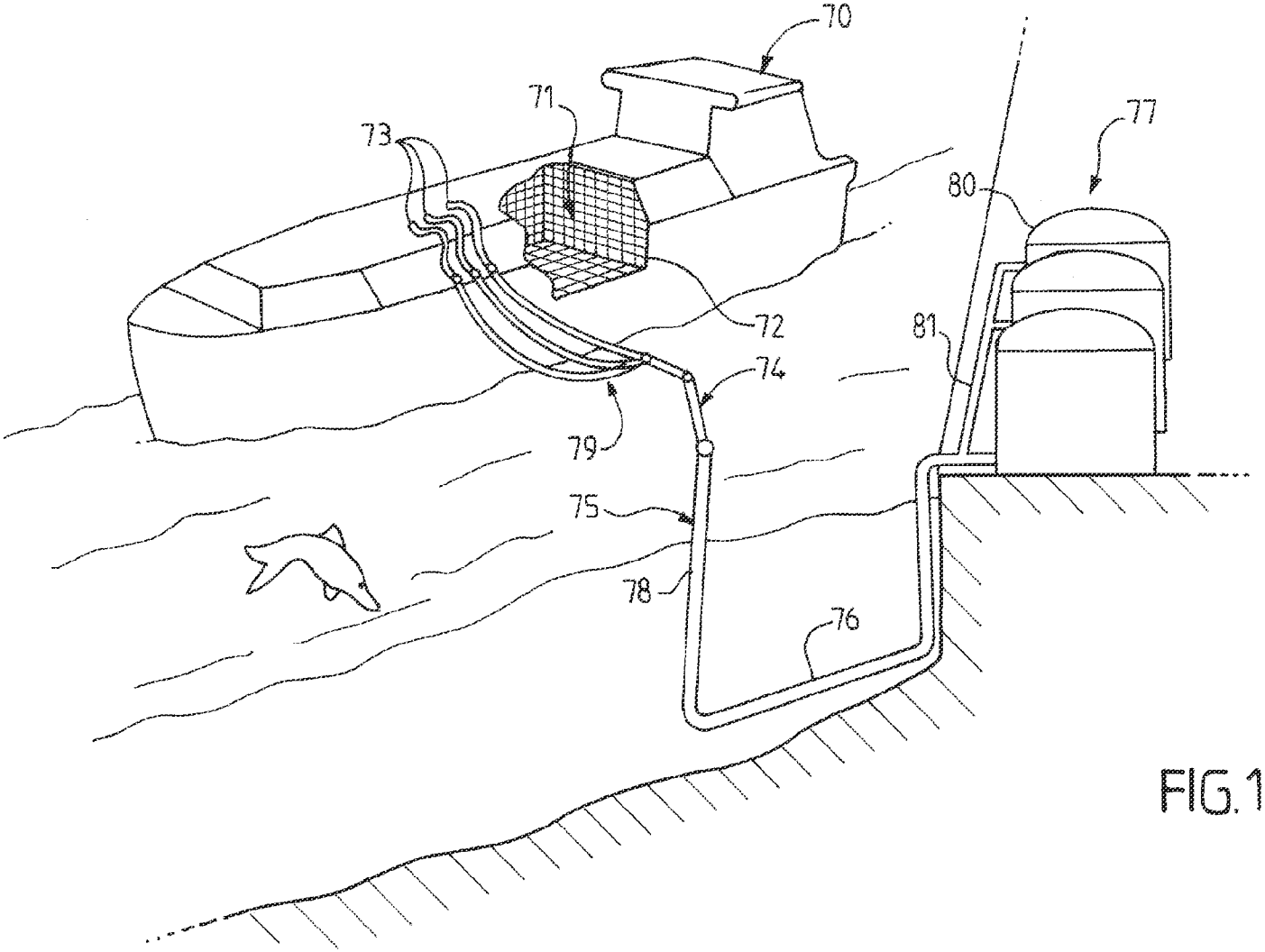
FIG. 13 is a cutaway diagrammatic representation of a tank of a methane tanker and a terminal for loading/offloading that tank.

Referring to FIG. 13, a cutaway view of a methane tanker ship 70 shows a sealed and insulated tank 71 of prismatic general shape mounted in the double hull 72 of the ship. The wall of the tank 71 includes a primary sealing barrier intended to be in contact with the LNG contained in the tank, a secondary sealed barrier disposed between the primary sealed barrier and the double hull 72 of the ship and two insulation barriers respectively disposed between the primary sealing barrier and the secondary sealing barrier and between the secondary sealing barrier and the double hull 72.

In a manner that is known in itself, loading/offloading pipes 73 disposed on the upper deck of the ship may be connected by means of appropriate connectors to a maritime or harbour terminal to transfer a cargo of LNG to or from the tank 71.

FIG. 13 represents an example of a maritime terminal including a loading and offloading station 75, a submarine pipe 76 and a land installation 77. The loading and offloading station 75 is a fixed offshore installation including a mobile arm 74 and a tower 78 that supports the mobile arm 74. The mobile arm 74 carries a bundle of insulated flexible pipes 79 adapted to be connected to the loading/offloading pipes 73. The orientable mobile arm 74 adapts to all methane tanker loading gauges. A connecting pipe that is not shown extends inside the tower 78. The loading and offloading station 75 enables loading and offloading of the methane tanker 70 from or to the land installation 77. The latter includes liquefied gas storage tanks 80 and connecting pipes 81 connected by the submarine pipe 76 to the loading or offloading station 75. The submarine pipe 76 enables transfer of liquefied gas between the loading or offloading station 75 and the land installation 77 over a long distance, for example 5 km, which enables the methane tanker ship 70 to remain at a great distance from the shore during the loading and offloading operations.

To generate the pressure necessary for the transfer of the liquefied gas, onboard pumps on the ship 70 are used and/or pumps equipping the land installation 77 and/or pumps equipping the loading and offloading station 75.

Although the invention has been described in connection with a plurality of particular embodiments, it is obvious that it is in no way limited to them and that it encompasses all technical equivalents of the means described as well as combinations thereof that fall within the scope of the invention.

The use of verbs such as "include" and "comprise" and their conjugate forms does not exclude the presence of other elements or other steps than those stated in a claim. The use of the indefinite article "a" or "an" for an element or a step does not exclude the presence of a plurality of such elements or steps, unless otherwise indicated.

In the claims, any reference symbol in brackets should not be interpreted as a limitation of the claim.

The invention claimed is:

1. Sealed and thermally insulative tank placed in a supporting structure, including:

secondary thermal insulation including a plurality of juxtaposed secondary insulation blocks on the supporting structure, a secondary seal including a plurality of sealed secondary metal plates disposed on the secondary insulation blocks and welded to each other, primary thermal insulation including a plurality of juxtaposed primary insulation blocks on the secondary seal, a primary seal including a plurality of sealed primary metal plates disposed on the primary insulation blocks and welded to each other, secondary mechanical coupling members extending through the secondary thermal insulation at the level of the edges of the secondary insulation blocks and holding the secondary insulation blocks in bearing engagement on the supporting structure, and primary mechanical coupling members extending through the primary thermal insulation at the level of the edges of the primary insulation blocks and holding the primary insulation blocks in bearing engagement on the secondary seal, wherein the primary metal plates, respectively the secondary metal plates, are disposed so that the edges of the metal plate are offset relative to the edges of the underlying primary insulation blocks, respectively secondary insulation blocks;

wherein the primary metal plates, respectively the secondary metal plates, are held in bearing engagement on the primary insulation blocks, respectively the secondary insulation blocks, only by the primary mechanical coupling members, respectively the second mechanical coupling members, and wherein the primary mechanical coupling members, respectively the secondary mechanical coupling members, are attached to the primary metal plates, respectively the secondary metal plates, at the level of attachment points away from the edges of the primary metal plates, respectively the secondary metal plates.

2. Tank according to claim 1, wherein the primary metal plates respectively the secondary metal plates, have a contour shape identical to the contour shape of the underlying primary insulation blocks, respectively the secondary insulation blocks.

3. Tank according to claim 2, wherein said contour shape is in each case rectangular.

4. Tank according to claim 1, wherein the primary metal plates respectively the secondary metal plates, are constituted of thin metal sheets conformed so as to have, in two orthogonal directions, corrugations projecting in the direction of the supporting structure, the primary insulation blocks, respectively the secondary insulation blocks, including grooves for accommodating said corrugations.

5. Tank according to claim 4, wherein the corrugations of a primary metal plate, respectively a secondary metal plate, are equidistant in each of their two directions.

6. Tank according to claim 5, wherein the distances between two successive corrugations of the two corrugation directions of a primary metal plate, respectively a secondary metal plate, are equal, so as to delimit on the two seals intercorrugation areas of square shape when viewed perpendicularly to the supporting structure.

7. Tank according to claim 4, wherein a primary mechanical coupling member, respectively a secondary mechanical coupling member, bear on the primary seal, respectively the secondary seal, in a plane area situated between the orthogonal corrugations of said seal.

8. Tank according to claim 4, wherein the grooves that receive the corrugations of the primary sealing plates and secondary sealing plates have a U-shaped or V-shaped cross section, the opening of the groove being adapted to the shape of the cross section of the corrugations.

9. Tank according to claim 8, wherein the cross section of the grooves is a V, the branches of which form between them an angle greater than or equal to 90°.

10. Tank according to claim 4, wherein a groove of a primary insulation block, respectively a secondary insulation block, is each time delimited by shims introduced into a groove wider than the groove, the shims leaving passages in said groove between the primary insulation block, respectively the secondary insulation block, and the corrugation of a primary sealing plate respectively a secondary sealing plate, accommodated in said groove.

11. Tank according to claim 1, wherein a primary mechanical coupling member, respectively a secondary mechanical coupling member, include a plate distributing the forces on the primary sealing barrier, respectively the secondary sealing barrier, and primary force transmission means, respectively secondary force transition means, connected to said plate, the force transmission means of the secondary mechanical coupling member being connected to the supporting structure.

12. Tank according to claim 11, wherein the force transmission means of the primary mechanical coupling member are connected to a secondary mechanical coupling member coaxial with the primary mechanical coupling member.

13. Tank according to claim 11, wherein the force transmission means of the primary mechanical coupling member are connected to a secondary insulation block at a distance from the edges of the secondary insulation block, the secondary mechanical coupling members associated with said secondary insulation block being offset relative to said primary mechanical coupling member.

14. Tank according to claim 1, wherein the primary insulation blocks, respectively the secondary insulation blocks, include notches on two opposite edges of said primary insulation blocks, respectively secondary insulation blocks, the notches in two adjacent primary insulation blocks, respectively secondary insulation blocks, being each time aligned to define a housing adapted to allow a primary mechanical coupling member, respectively a secondary mechanical coupling member, to pass through it.

15. Tank according to claim 1, wherein the primary insulation blocks, respectively the secondary insulation blocks, are cut off at the corners of said primary insulation blocks, respectively said secondary insulation blocks, the cut-off corners of four adjacent primary insulation blocks, respectively secondary insulation blocks, each time defining a housing adapted to allow a primary mechanical coupling member, respectively a secondary mechanical coupling member, to pass through it.

16. Tank according to claim 1, wherein a primary insulation block, respectively a secondary insulation block, are constituted of a layer of insulative foam flanked on its two larger faces by a plywood sheet.

17. Ship for the transportation of a cold liquid product, the ship including a double hull and a tank according to claim 1 disposed in the double hull.

18. Use of a ship according to claim 17, wherein a cold liquid product is routed through insulated pipes from or to a floating or terrestrial storage installation to or from the tank of the ship to effect the loading or offloading of the ship.

19. Transfer system for a cold liquid product, the system including a ship according to claim 17, insulated pipes arranged to connect the tank installed in the hull of the ship to a floating or terrestrial storage installation and a pump for driving a flow of cold liquid product through the insulated pipes from or to the floating or terrestrial storage installation to or from the tank of the ship.

* * * * *